United States Patent [19]

Weikert et al.

[11] 4,219,239

[45] Aug. 26, 1980

[54] MINING AUGER

[75] Inventors: Norbert B. Weikert, Dortmund; Hans Tekathen, Dinslaken; Heinrich Schulte, Hattingen, all of Fed. Rep. of Germany

[73] Assignee: Krampe & Co., Hattingen, Fed. Rep. of Germany

[21] Appl. No.: 955,630

[22] Filed: Oct. 30, 1978

[51] Int. Cl.[2] ..... E21B 35/22

[52] U.S. Cl. ..... 299/81; 299/90

[58] Field of Search ..... 299/89, 90, 81; 175/393

[56] References Cited

U.S. PATENT DOCUMENTS

| | | | |
|---|---|---|---|
| 3,747,982 | 7/1973 | Agnew | 299/81 |
| 3,847,439 | 11/1974 | Allen | 299/81 |
| 4,022,286 | 5/1977 | Gill | 299/81 |

FOREIGN PATENT DOCUMENTS

| | | | |
|---|---|---|---|
| 543440 | 2/1942 | United Kingdom | 299/81 |

OTHER PUBLICATIONS

Condensed Chemical Dictionary, Eighth Edition, Hawley, p. 826, N.Y., N.Y., 1971.

*Primary Examiner*—William F. Pate, III
*Attorney, Agent, or Firm*—Spencer & Kaye

[57] ABSTRACT

A mining auger has a hollow auger shaft terminating in a front end, an auger helix welded to the outer face of the shaft and having a peripheral edge zone radially spaced from the shaft surface and extending helically thereabout; a plurality of spaced tool holders arranged in the peripheral edge zone of the helix for receiving cutting tool bits; separate spray nozzles arranged in the peripheral edge zone and associated with each cutting tool bit; a liquid supply channel provided in the shaft; a distributor channel communicating with the supply channel and following the helical course of the helix; and connecting channels leading to individual spray nozzles and communicating with the distributor channel. The distributor channel is situated at a substantial radial distance from the outer face of the auger shaft in the direction of the nozzles. There is further provided a bridging channel which extends radially away from the outer surface of the auger shaft and which is located externally of outer wall faces of the helix. The bridging channel connects the supply channel with the distributor channel.

34 Claims, 5 Drawing Figures

MINING AUGER

BACKGROUND OF THE INVENTION

This invention relates to a mining auger used in particular for the underground mining of coal. The auger has a hollow shaft and at least one helix attached to the outer cylindrical face of the shaft. The helix carries, along its outer edge, a plurality of spaced cutting tool bits.

Single-helix or multi-helix augers for the underground mining of coal are known in which separate spray nozzles are associated with the individual cutting tool bits in order to cause settling of rock and coal dust generated during the operation of the auger. As a rule, the nozzles are so oriented that each cutting bit is exposed to one part of the jet approximately in the upper third of the free bit length. As a result, the tool bits are simultaneously cooled which lengthens their service life. The water is admitted to the nozzles—which are arranged in the auger helix—through the auger shaft. From the shaft the water enters into a distributor channel which is arranged in the foot zone of the respective helix and in the frontal end ring of the auger. It is further conventional to arrange the distributor channel directly in the foot zone of the end ring and orient it in the circumferential direction thereof. Or, the distributor channel is located centrally in the foot zone of the respective helix (the foot zone is in contact with the outer face of the auger shaft). In the latter case, the distributor channel has a course which corresponds to that of the helix and extends in the direction of the outer face of the hollow auger shaft. The openings of the individual nozzles are connected with the distributor channel by means of radially extending connecting channels in the end ring and in the helix. In the known structures the connecting channels are provided by deep-drilling.

It was found that connecting channels which are constituted by deep-drilled bores involve substantial manufacturing disadvantages. They have to be made with special deep-drilling machines which involves substantial manufacturing costs. It is a particularly significant disadvantage that such distributor channels are always arranged close to the outer surface of the auger shaft. Thus, these channels are located in a zone on which forces generated during the operation of the auger act with a particularly large lever arm. Since both the helix and the end ring are connected to the shaft by welds, these forces have their effect precisely in a zone which is critical concerning the liquidtight properties of the distributor channels. It was found in practice that the distributor channels often loose these properties during operation, because the forces acting on the hollow auger shaft through large lever arms frequently cause hairline ruptures which, after a short time, lead to substantial leaks of the distributor channels. An additional difficulty in practice was found to be the fact that the helices have to be bent or pressed into a relatively complicated spiral configuration. Similarly, the foot zones which have to be welded to the outer face of the auger shaft have also such a complex shape. In practice, however, it has been found impossible to bend or press the foot zones in an ideal manner to ensure that the walls of the distributor channel lie squarely on all upper surface zones of the auger shaft. Such a positioning, however, is a precondition for a tight welding. On the contrary, it was found in practice that at several locations of the foot zones, unavoidable gas of greater or lesser dimensions appear which are caused by the inherent inaccuracies in the manufacture during bending or pressing of the helices. If now subsequently the foot zone is welded to the auger shaft, weld beads will penetrate into the distributor channel leading, after a short time, to significant corrosions within the channel system. As a result, the nozzles, whose openings often have a diameter of only one millimeter or less, are partially or entirely clogged by the corrosion-caused deposits after a relatively short service life, so that the dual function of the nozzle (namely dust precipitation and a cooling of the hard metal tool bits) can no longer be performed. A further consequence is an overall unsatisfactory operation of the mining auger which thus, after a short period of time, has to be disassembled, moved above ground and repaired in a circumstantial manner, for example, by drilling out the throat welds of the helix and then repairing the same by rewelding.

SUMMARY OF THE INVENTION

It is an object of the invention to provide an improved mining auger of the above-outlined type from which the discussed disadvantages of prior art structures are eliminated. It is thus an object of the invention to provide an auger with individual nozzles in which the nozzle openings are not clogged by corrosion deposits even after relatively long service life and wherein manufacturing tolerances of the helices or end rings can have no disadvantageous effect on the liquidtight properties of the channel system.

These objects and others to become apparent as the specification progresses, are accomplished by the invention, according to which, briefly stated, the mining auger has a hollow auger shaft terminating in a front end, an auger helix welded to the outer face of the shaft and having a peripheral edge zone radially spaced from the shaft surface and extending helically thereabout, an end ring welded to the shaft at the front end thereof and having a circular peripheral edge zone radially spaced from the shaft surface, a plurality of spaced tool holders arranged in the peripheral edge zone of the helix and the end ring for receiving cutting tool bits; separate spray nozzles arranged in the peripheral edge zones and associated with each cutting tool bit; at least one liquid supply channel provided in the shaft; at least one distributor channel associated with the helix and following the helical course thereof; at least one distributor channel associated with the end ring and extending circularly about the auger shaft; and connecting channels leading to individual spray nozzles and being coupled to the respective distributor channel. The distributor channels communicate with the supply channel. Each distributor channel is situated at a substantial radial distance from the outer face of the auger shaft in the direction of the nozzles and further, for coupling the distributor channel in the helix with the supply channel there is provided a bridging channel which extends radially away from the outer surface of the auger shaft and which is located externally of outer wall faces of the helix.

By providing that the distributor channel is at a significant radial distance from the outer face of the hollow auger shaft in the direction of the nozzles, forces generated during the operation of the mining auger can no longer have an effect on the distributor channel through a long lever arm and thus can no longer tear open the welds or other connections. This feature by itself ensures that the entire channel system remains, without the need of maintenance, liquidtight many times longer than it has been the case in prior art structures. Thus, manufacturing inaccuracies involved in the bending or pressing of the helices can no longer have a disadvantageous effect on the liquidtight properties of the distributor channel. Particularly with regard to the liquidtight properties of the distributor channel and the remainder of the channel systems, it is entirely without significance whether or not the foot zone at some locations is spaced from the outer surface of the auger shaft. It is thus no longer a requirement that the foot zones engage face-to-face the outer surface of the auger shaft at all locations. The invention ensures that weld beads cannot enter into the channel system, so that during operation no corrosion phenomena can spread from such weld seams or weld beads and thus a clogging of the nozzles is securely prevented.

Further, the helix or end ring need not accommodate the distributor channel proper. Rather, the distributor channel may be arranged adjacent, that is, externally of the wall proper of the respective helix or end ring in a significant radial distance from the outer face of the auger shaft. By providing—according to a further feature of the invention—the channels of the mining auger, that is, the supply channel, the respective distributor channels and the connecting channels and other connections within the mining auger with a proper corrosion-resistant lining up to the nozzles, an occurrence of corrosion-caused deposits within the entire channel system is positively prevented. In this manner the entire channel system can be operated in a maintenance-free manner. As a result, the mining auger according to the invention can operate over extended periods in an environmentally satisfactory (pollution-free) manner and with a large mining output particularly in cases where the entire mining auger is of stainless steel, such as Nirosta or another appropriate steel such as a chromium-molybdenum-manganese-nickel alloy.

According to a further feature of the invention, the bridging channel is constituted by a member of U-shaped cross section which is secured at its legs to the respective helix and/or to the end ring in a liquidtight manner. Such an arrangement results in a particularly simple and robust construction which is easy to manufacture and thus can be made at low cost.

According to a further feature of the invention, the bridging channel is connected with the distributor channel solely by a stub (short-length) channel which extends parallel to the longitudinal axis of the mining auger. This arrangement has the advantage that no long connecting means are present which could lead to leaks in the entire channel system. In the known structures, in contradistinction, the entire circumferential zone of the end ring is prone to leakages in the height of the external surface of the auger shaft. This applies to an even greater measure to the entire longitudinal circumferential zone of the helices and also to the zone of the outer surface of the auger shaft, since in these zones, namely on both sides of the respective helix, there are long weld seams which are likely to loose their liquidtight properties.

According to a further feature of the invention, the connecting channels, as they extend in the radial direction, are coupled in a liquidtight manner to one and the same distributor channel. Since the distributor channel, in accordance with the invention, is at a substantial radial distance from the outer surface of the auger shaft, the connecting channels which may be bores, can have a relatively short length so that expensive and complicated deep-drilled bores of prior art structures can be dispensed with.

According to a further feature of the invention, the distributor channel is constituted by a groove which is provided unilaterally in the respective side wall of the helix or which is provided unilaterally in the rear wall of the end ring. Such a groove may be machined in a simple manner by milling or by turning, if it is to be provided in the end ring. The groove is sealed towards the outside, for example, by a correspondingly curved metal strip which is expediently connected with the helix or the end ring by weld seams.

According to a further feature of the invention, the corrosion-resistant coating is a hardenable synthetic resin. This material may be simply poured into the channel system in liquid form and then allowed to harden with a certain thickness. In this manner all channel walls are coated reliably with a film or layer of synthetic resin, so that during the subsequent flow of water no surfaces remain exposed to corrosion.

It is also feasible to introduce into the channel system an appropriate powder which, for example, by heating, may be caused to be sintered. In this manner a tough, corrosion-resistant coating is provided which covers the channel walls.

In accordance with a further feature of the invention, the coating or lining is constituted by plastic hoses which are welded to one another. These hoses are first drawn into the channels, then cut to length and interconnected by plastic welding.

In accordance with a further feature of the invention, the distributor channel associated with the end ring is arranged in the transitional zone between a conical part and a radial part of a generally conical end ring. Such a solution is particularly simple because prior to welding the conical part and the radial part of the respective conical end ring to one another, between the two facing ends of the respective end ring parts, a duct or a body shaped as a right-angled triangle made of stainless steel or the like may be arranged to constitute the distributor channel. It is, however, feasible to provide, within the scope of the invention, structures wherein the walls of the distributor channel are constituted exclusively by the end faces or the like of the conical or the radial part of the respective conical end ring.

According to a further feature of the invention, the entire mining auger is made of an appropriate stainless steel. In this manner the service life of not only the entire channel system but also of the auger itself can be extended to a multiple value as compared to prior art structures.

According to a further feature of the invention, the auger shaft, the helices, as well as the end ring are all preferably made of stainless steel and further, each tool bit holder is welded into a separate holder bed made of a normal, weldable steel. Each holder bed is welded to the associated helix or end ring. The channels may be machined into the helices so that the spray nozzles can be properly mounted thereon without difficulty. This arrangement ensures that during the use of normal fresh water a self-soiling originating from the inside of the auger cannot occur. The holder beds are thus made of a weldable and flame-cuttable steel to ensure that the costs of later repairs remain low. The holder beds are connected with the stainless steel components, that is, with the end ring and the helices, while the bit holders themselves are connected by weld seams with the receiving steel member of the respective holder bed in the usual manner. If later, during service, it is necessary to remove the tool bit holders for repairs, the same can be simply burned out of the holder beds which, in case of stainless steel components, would not be feasible. By making the entire auger of stainless steel, it is practically totally protected against corrosion and has a longer service life than the conventional structures. In this manner the spray nozzles cannot be clogged by rust particles, scale, weld beads, or the like. Advantageously, the flow passage of the nozzles has a cross-sectional diameter of 1 mm. Further, the nozzles are arranged in such a manner that the tool bits are sprayed at the upper one-third of their length. In this manner a wear of the tool bits is substantially reduced. Since in the prior art structures, because of the frequent clogging of the spray nozzles, the same have to be often replaced, the nozzle threads with which they are secured to the auger were frequently damaged. As a result, the respective spray nozzles in these known structures are not supported properly and, as a rule, have been breaking off. The possibility of such an occurrence is excluded in the mining auger according to the invention, since the spray nozzles practically need no longer be replaced; they remain substantially longer operational than it was possible in prior art structures. As a result, this embodiment too, provides a pollution-free mining auger, in the vicinity of which operating personnel is protected in a highly effective manner against rock and coal dust, since the spraying nozzles operate continuously in a reliable manner.

DESCRIPTION OF THE PREFERRED EMBODIMENTS

Figure 1:
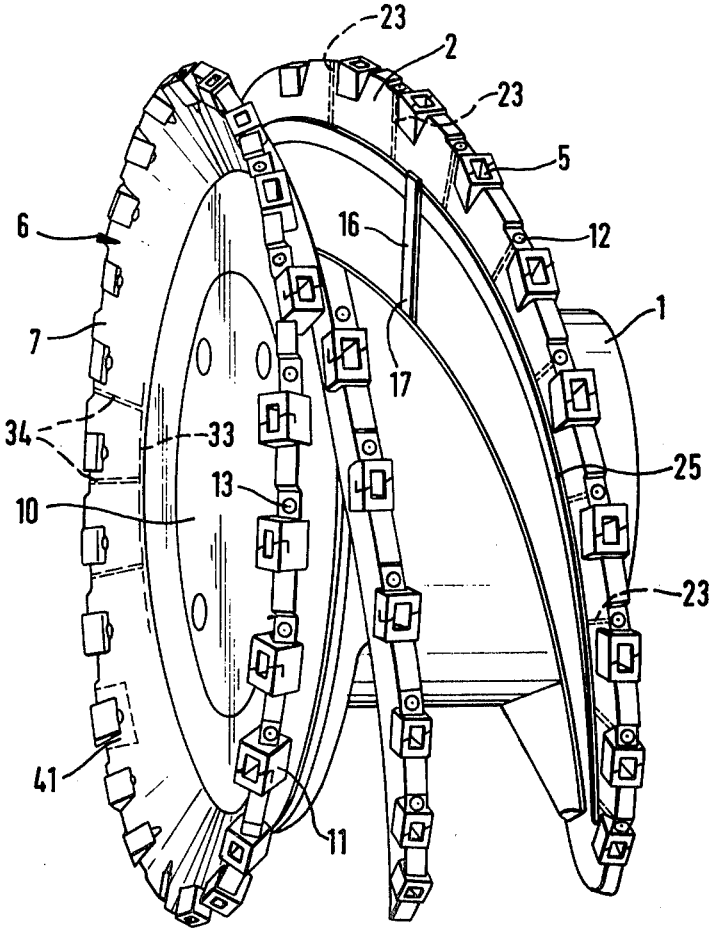
FIG. 1 is a perspective view of a mining auger according to a preferred embodiment (the cutting tool bits are omitted).
Figure 2:
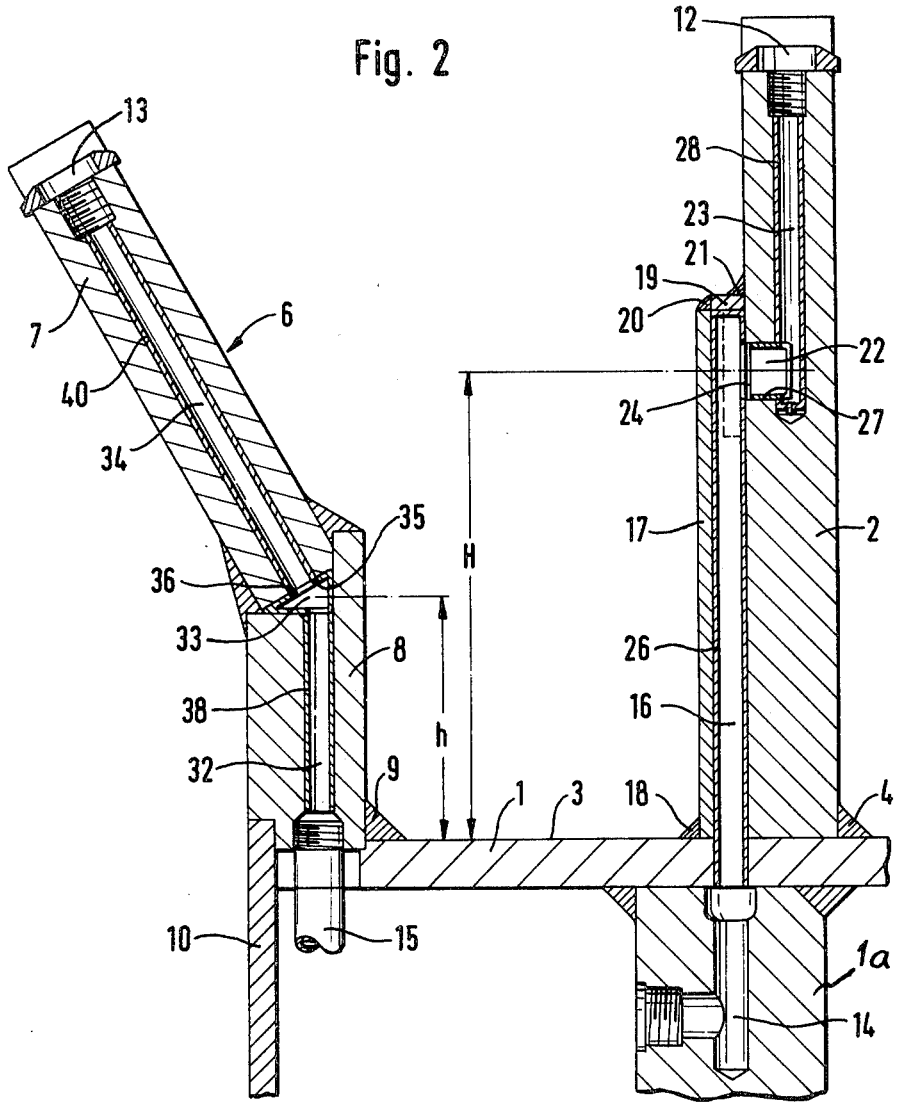
FIG. 2 is a fragmentary axial sectional view of the same embodiment.

Turning now to FIGS. 1 and 2, there is shown a hollow (tubular) auger shaft 1 carrying a helix 2. The latter is formed of an edgewise oriented sheet metal member which extends helically about the auger shaft 1 and is fixedly attached thereto by weld seams 4 connecting the foot portion of the helix with the external face 3 of the shaft 1. At the outer circumferential zone, the helix 2 is provided with a plurality of uniformly spaced tool bit holders 5, each adapted to receive a tool bit (not shown in the drawings). Instead of a single helix, as shown in FIG. 1, it is feasible to provide two or more helices which may be arranged on the auger shaft with a certain angular offset. Such additional helices have the same structure as the single helix shown in FIG. 1.

Figure 3:
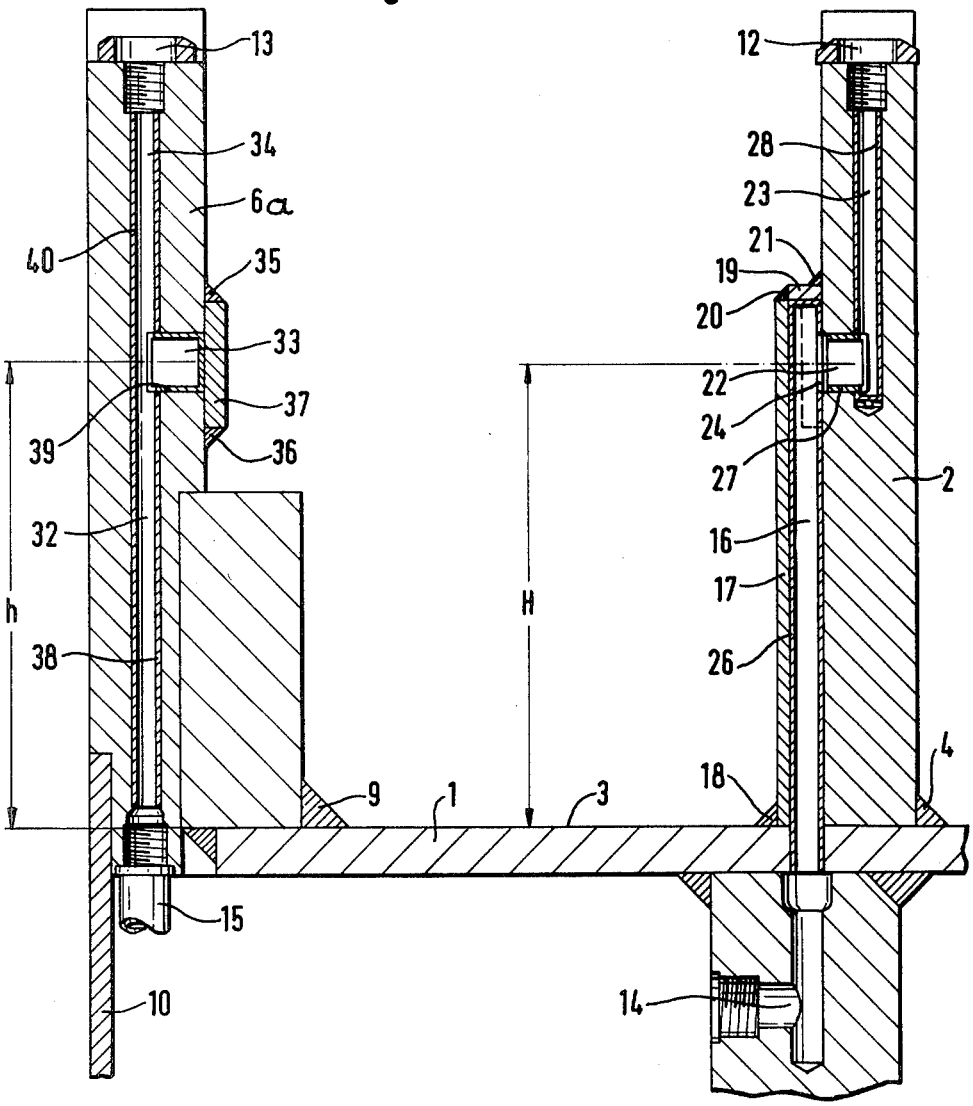
FIG. 3 is a fragmentary axial sectional view of a mining auger having a straight (radially extending) end ring.
Figure 4:
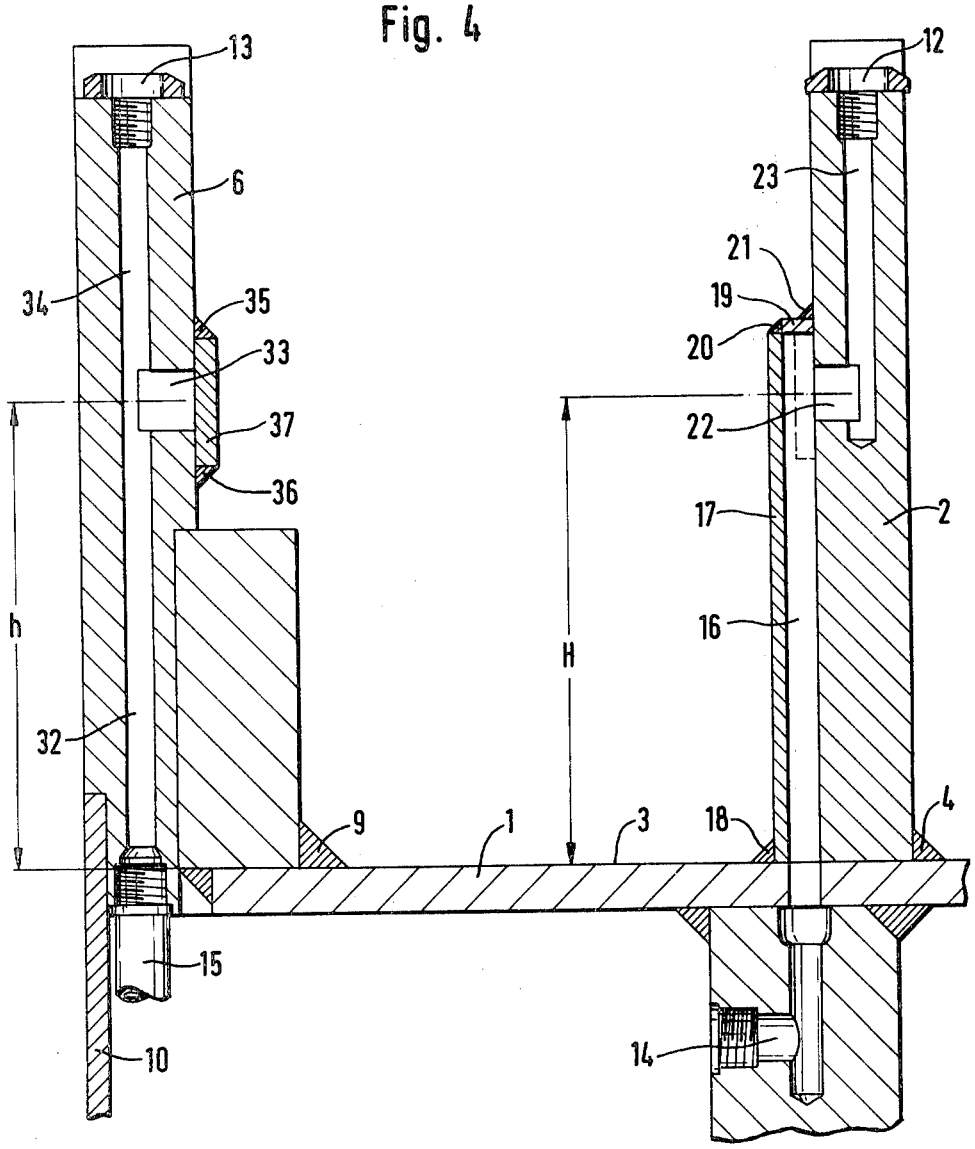
FIG. 4 is a fragmentary axial sectional view of another preferred embodiment of the invention.
Figure 5:
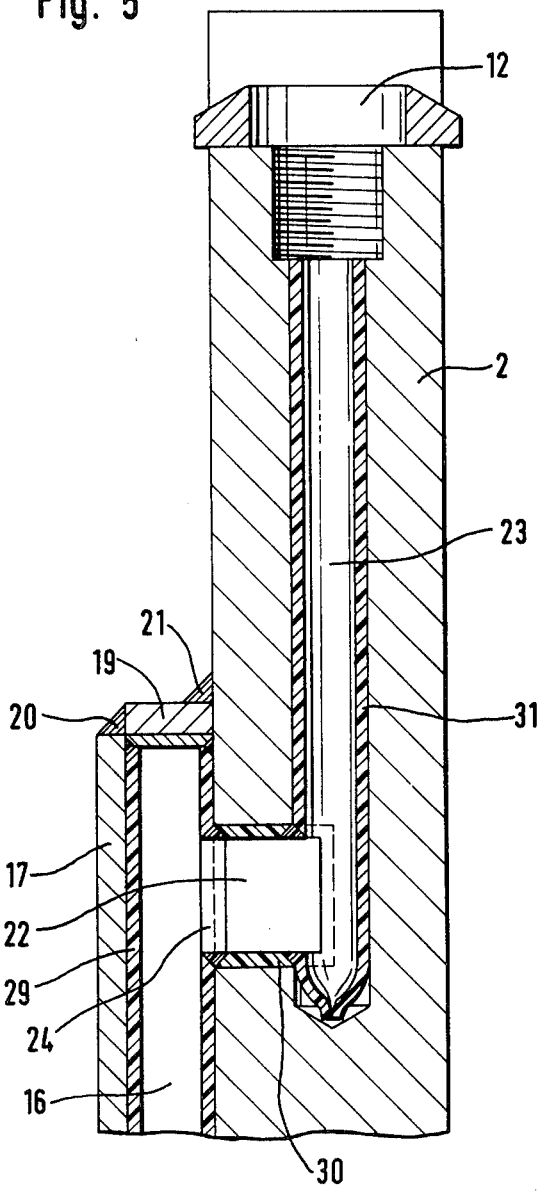
FIG. 5 is a fragmentary axial sectional view of still another preferred embodiment of the invention.

At the leading end of the auger shaft 1, there is provided an end ring 6 which, in the embodiments according to FIGS. 1 and 2, is conically shaped, whereas in the embodiments according to FIGS. 3 through 5, it has a straight (planar) configuration, that is, it extends only in a radial direction relative to the longitudinal axis of the mining auger. The conical end ring 6 is formed of two components, such as a conical part 7 which diverges from the auger axis in the direction of the adit (front) end and a radial part 8 which is connected by welds to the conical part 7 and is further secured by welds 9 to the outer face of the auger shaft 1. The latter is, at its leading end, closed off by a closure disc 10 which seals the inside of the hollow auger shaft 1 in the forward direction.

The end ring 6 is, similarly to the helix 2, provided at its outer circumference with uniformly spaced tool bit holders 11 each adapted to receive a cutting tool bit (not shown).

With each tool bit holder 5 and 11 there is associated a separate spray nozzle 12 and 13, respectively, which emits a water jet in a predetermined orientation. The water jet is so oriented that it impinges on the associated cutting tool bit at least in part approximately in its upper third of its length to cool the same. This ensures that the hard metal tool bits will not melt out from their support by the heat generated during operation. In this manner the service life of the cutting tool bits is increased. Further, the mining auger is, by virtue of the operation of the nozzles, surrounded by a shroud of water spray, thus preventing the generation of dust clouds during the mining operation. As a result, mining augers of this type operate in a pollution-free manner.

Within the hollow shaft 1, in a block member 1*a*, there is provided a liquid supply channel 14 for the associated helix 2. The supply channel 14 is connected to a conduit, such as a water hose (not shown). In the hollow shaft 1 there is further secured an only schematically indicated liquid supply channel 15 for admitting liquid to the end ring 6.

In all the embodiments, the supply channel 14 is connected liquidtight to a bridging channel 16 which extends radially away from the shaft 1 and which is essentially formed of a duct member 17 of U-shaped cross section. The duct 17 is attached liquidtight to the outer surface 3 of the auger shaft 1 by welds 18. Further, the legs of the "U" (which are not visible in the Figures) are connected in a liquidtight manner with the outer wall face of the helix 2. The radially outer end of the duct 17 is closed off by a plate member 19 and by welds 20 and 21 in a liquidtight manner. The walls of the duct 17 and the plate 19 may constitute directly the channel walls of the bridging channel 16.

Within the wall of the helix 2, there is provided a distributor channel 22 which is situated at a substantial radial distance H from the outer face 3 of the auger shaft 1. It may be observed, for example, in FIG. 2, that the distance H is more than one half of the radially measured height dimension of the helix 2. The distributor channel 22 extends within the helix 2 about the axis of the auger, while maintaining throughout the distance H constant. At the beginning and the end of the distributor channel 22 there are provided cleaning openings 50 (only one is visible) each normally closed by a threaded plug 51. To the distributor channel 22 there are coupled, in a liquidtight manner, connecting channels 23 formed by bore holes. Each nozzle 12 is associated with a separate connecting channel 23 as indicated in phantom lines in FIG. 1.

The distributor channel 22 is coupled with the associated bridging channel 16 by means of a short stub channel 24 which extends parallel to the auger axis. It is feasible, however, to arrange the distributor channel 22 with one of its lateral boundaries in the plane of the bridging channel 16 and to cover it towards the outside with a sheet metal strip 25 (FIG. 1) attached thereto by welds (not shown) in a liquidtight manner. In such a case, the stub channel 24 is constituted merely by a transitional opening of the distributor channel 22 in the bridging channel 16 between the legs of the U-shaped duct member 17 that defines the bridging channel 16.

In the embodiments illustrated in FIGS. 1, 2 and 3, the bridging channel 16 is lined with a stainless steel sheet member 26. The stub channel 24 and the distributor channel 22 too, are protected against corrosion by a stainless steel sheet member 27. The same applies to all the connecting channels 23 which, in turn, are protected by a stainless steel member 28. In this manner the channel system is completely protected against corrosion up to the liquid supply channel 14.

In the embodiment according to FIG. 4, the walls of the bridging channel 16, the stub channel 24 and the distributor channel 22 as well as the connecting channels 23 are provided with a sintered layer or with a hardenable synthetic resin layer (not shown) which ensure protection of these components against corrosion. Further, in the embodiment according to FIG. 4, the supply channel 14 too, is provided with such a corrosion-resistant layer.

In the embodiment according to FIG. 5, the bridging channel 16, the stub channel 24, the distributor channel 22 and all the connecting channels 23 are covered in a liquidtight manner with hoses 29, 30 and 31 made of a synthetic material. At their abutting locations these hoses are connected with one another by means of plastic weld seams or by means of gluing. The liquid supply channel 14, which is not shown in FIG. 5 can also be protected against corrosion by such a hose arranged therein.

The channel system associated with the end ring 6 (FIGS. 1 and 2) and 6*a* (FIGS. 3 and 4) is protected against corrosion in a similar manner. In the embodiment according to FIGS. 1 and 2, the bridging channel 32 is constituted by a bore hole in the radial part 8 of the conical end ring 6; the bridging channel 32 merges into a distributor channel 33 which is arranged at a substantial radial distance h practically at the outermost end of the radial part 8 and has the approximate cross section of a right-angled triangle. The distributor channel 33 which communicates with the supply channel 15 by the radially extending bridging channel 32 provided in the radial end ring part 8 extends in the circumferential direction of the radial component 8 and thus is of annular shape. With the circular distributor channel 33 connecting channels 34 are coupled. With each spray nozzle 13 there is associated a separate connecting channel 34 (illustrated schematically with dash-dot lines in FIG. 1). In the embodiment according to FIGS. 1 and 2, the distributor channel 33 is arranged between the two facing ends of the conical ring part 7 and the radial ring part 8. The two ring parts 7 and 8 are connected with one another by means of weld seams 35 and 36. In contradistinction to the embodiment illustrated in the Figures, the bridging channel 32 can be of a configuration similar to the bridging channel 32 can be of a configuration similar to the bridging channel 16 of the helix 2, that is, it may be arranged on the backside of the ring component 8 externally thereof, thus facing the helix 2. In case the bridging channel 32 has a U-shaped structure similar to the duct 17, it is formed and arranged in the same manner as the component 17. In such a case the inner chamber of the U-shaped duct may be connected by a stub channel or, as the case may be, by a transitional zone with the circularly extending distributor channel 33.

The distributor channel 33 is provided with a cleaning opening 52, normally closed by a plug 53.

In the embodiments according to FIGS. 3 and 4, the circularly extending distributor channel 33 is covered outwardly by an annular sheet metal member 37 attached to the wall face of the end ring 6*a* in a liquidtight manner by means of weld seams 35 and 36. With the distributor channel 33 there are coupled connecting channels 34 and—similarly to the embodiment according to FIGS. 1 and 2—with each spray nozzle 13 there is associated a separate connecting channel 34 (not shown in detail in the drawings).

In the embodiments according to FIGS. 1, 2 and 3, the bridging channel 32, the distributor channel 33 and the connecting channels 34 are cladded with a stainless steel sheet and thus are fully protected against corrosion. The supply channel 15 too, can be at least in part provided with such a cladding or may consist of another corrosion-resistant material.

The bridging channel 32, the distributor channel 33 and the connecting channels 34 of the embodiment according to FIG. 4 are protected against corrosion by a corrosion-resistant sintered layer or a hardenable synthetic resin layer while these channels of the FIG. 5 embodiment are protected against corrosion by synthetic hoses placed therein.

Reverting once again to FIG. 1, there is schematically illustrated therein a further feature of the invention. In this case the end ring 6 and the helix 2 as well as the auger shaft 1 are made of an appropriate stainless steel, for example Nirosta or another steel alloy such as a chromium-molybdenum-nickel alloy. In such a case the cutting tool holders 5, to be sure, can be connected with the stainless steel components by means of known welding processes with weld seams, yet, subsequent repair works may involve certain difficulties since in such a case, as a rule, the tool holders 5 have to be flame-cut from the helix 2 or the end ring 6 and since stainless steel may not be worked with in the same simple manner as normal (non-stainless) steel. For this reason, according to the invention, the cutting tool holders 5 are arranged in tool holder beds 41, schematically shown in phantom lines in FIG. 1. The tool holder beds are blocks made of an appropriate steel so that they can be cut with a welding torch in the usual manner. The tool holder beds 41 are connected by weld seams with the respective stainless steel components, whereas the respective tool holder 5 is, in turn, connected with weld seams in the usual manner with the associated tool holder bed 41. If subsequent repairs are necessary, the tool holders 5 may be removed in a simple manner from the tool holder bed 41 with a welding torch, while the weld seams with which the tool holder bed 41 is connected with the stainless steel components need not be broken.

It is noted that the stainless steel properties may be given by a proper tinning of the respective components or by providing them with a coating in a galvanizing process.

It is to be understood that the above-described and illustrated features of the mining auger may be combined in a desired manner.

It is to be understood that the above description of the present invention is susceptible to various modifications, changes and adaptations, and the same are intended to be comprehended within the meaning and range of equivalents of the appended claims.

What is claimed is:

1. In a mining auger having a hollow auger shaft terminating in a front end, an auger helix welded to the outer face of the shaft and having a peripheral edge zone radially spaced from the shaft surface and extending helically thereabout; a plurality of spaced tool holders arranged in the peripheral edge zone of the helix for receiving cutting tool bits; separate spray nozzles arranged in the peripheral edge zone and associated with each cutting tool bit; a liquid supply channel provided in the shaft; a distributor channel communicating with the supply channel and following the helical course of the helix, connecting channels leading to individual spray nozzles and communicating with the distributor channel; and a bridging channel extending radially away from the outer surface of said auger shaft and connecting said supply channel with said distributor channel; the improvement comprising cleaning openings provided at both ends of said distributor channel; and plug means for closing said cleaning openings.

2. In a mining auger having a hollow auger shaft terminating in a front end, an auger helix welded to the outer face of the shaft and having a peripheral edge zone radially spaced from the shaft surface and extending helically thereabout; a plurality of spaced tool holders arranged in the peripheral edge zone of the helix for receiving cutting tool bits; the improvement comprising an end ring welded to said shaft at the front end thereof and having a circular peripheral edge zone radially spaced from the shaft surface; a plurality of spaced tool holders arranged in the peripheral edge zone of said end ring for receiving cutting tool bits; separate spray nozzles arranged in the peripheral edge zone of said end ring and associated with each cutting tool bit; a liquid supply channel provided in the shaft; a distributor channel connected with said end ring and extending circularly about the auger shaft; said distributor channel communicating with said supply channel; connecting channels leading to individual spray nozzles and communicating with said distributor channel; a bridging channel carried by said end ring and extending radially away from the outer surface of said auger shaft; said bridging channel connecting said supply channel with said distributor channel; further comprising a cleaning opening provided in said distributor channel; and plug means for closing said opening.

3. In a mining auger having a hollow auger shaft terminating in a front end, an auger helix welded to the outer face of the shaft and having a peripheral edge zone radially spaced from the shaft surface and extending helically thereabout; a plurality of spaced tool holders arranged in the peripheral edge zone of the helix for receiving cutting tool bits; the improvement comprising an end ring welded to said shaft at the front end thereof and having a circular peripheral edge zone radially spaced from the shaft surface; a plurality of spaced tool holders arranged in the peripheral edge zone of said end ring for receiving cutting tool bits; separate spray nozzles arranged in the peripheral edge zone of said end ring and associated with each cutting tool bit; a liquid supply channel provided in the shaft; a distributor channel connected with said end ring and extending circularly about the auger shaft; said distributor channel communicating with said supply channel; connecting channels leading to individual spray nozzles and communicating with said distributor channel; a bridging channel carried by said distributor channel; a bridging channel carried by said end ring and extending radially away from the outer surface of said auger shaft; said bridging channel connecting said supply channel with said distributor channel; further wherein said end ring has a radial part affixed to said shaft and a conical part affixed to said radial part at an outer circumferential zone thereof; said tool holders and said nozzles being arranged at an outer peripheral zone of said conical part; and further wherein said distributor channel is situated in a transitional zone between said radial part and said conical part.

4. In a mining auger having a hollow auger shaft terminating in a front end, an auger helix welded to the outer face of the shaft and having a peripheral edge zone radially spaced from the shaft surface and extending helically thereabout; a plurality of spaced tool holders arranged in the peripheral edge zone of the helix for receiving cutting tool bits; separate spray nozzles arranged in the peripheral edge zone and associated with each cutting tool bit; a liquid supply channel provided in the shaft; a distributor channel communicating with the supply channel and following the helical course of the helix; and connecting channels leading to individual spray nozzles and communicating with the distributor channel; the improvement comprising a bridging channel extending radially away from the outer surface of said auger shaft and being located externally of outer wall faces of said helix; said bridging channel being formed of a duct member of U-shaped cross section attached liquidtight along its free edges to an external wall face of said helix; whereby said bridging channel has a passage of rectangular cross section bounded on three sides by inner wall faces of said duct member and on one side by said external wall face of said helix; said bridging channel connecting said supply channel with said distributor channel.

5. In a mining auger having a hollow auger shaft terminating in a front end, an auger helix welded to the outer face of the shaft and having a peripheral edge zone radially spaced from the shaft surface and extending helically thereabout; a plurality of spaced tool holders arranged in the peripheral edge zone of the helix for receiving cutting tool bits; the improvement comprising an end ring welded to said shaft at the front end thereof and having a circular periheral edge zone radially spaced from the shaft surface; a plurality of spaced tool holders arranged in the peripheral edge zone of said end ring for receiving cutting tool bits; separate spray nozzles arranged in the peripheral edge zone of said end ring and associated with each cutting tool bit; a liquid supply channel provided in the shaft; a distributor channel connected with said end ring and extending circularly about the auger shaft; said distributor channel communicating with said supply channel; connecting channels leading to individual spray nozzles and communicating with said distributor channel; a bridging channel carried by said end ring and extending radially away from the outer surface of said auger shaft; said bridging channel being formed of a duct member of U-shaped cross section attached liquidtight along its free edges to an external wall face of said end ring, whereby said bridging channel has a passage of rectangular cross section bounded on three sides by inner wall faces of said duct member and on one side by said external wall face of said end ring; said bridging channel connecting said supply channel with said distributor channel.

6. A mining auger as defined in claim 1, wherein said bridging channel is a duct member of U-shaped cross section attached liquidtight along its free edges to an external wall face of said helix.

7. A mining auger as defined in claim 1 or 4 further comprising a stub channel connecting said bridging channel to said distributor channel and being oriented parallel to the auger axis.

8. A mining auger as defined in claim 1 or 4 wherein each connecting channel extends from said distributor channel to the respective nozzles in a direction radially away from said shaft.

9. A mining auger as defined in claim 1 or 4 wherein said distributor channel is a groove machined in an outer wall face of said helix; the improvement further comprising a closure member covering said groove and being attached liquidtight to said outer wall face.

10. A mining auger as defined in claim 9, wherein said closure member is a helically extending strip welded to said outer wall face.

11. A mining auger as defined in claim 1 or 4 wherein at least some of said channels have a corrosion-resistant lining.

12. A ming auger as defined in claim 11, wherein said lining is a plastic hose.

13. A mining auger as defined in claim 11, wherein said lining is a sintered plastic.

14. A mining auger as defined in claim 11, wherein said lining is a stainless steel coating.

15. A mining auger as defined in claim 14, wherein said stainless steel coating is a chromium-molybdenum-nickel steel alloy.

16. A mining auger as defined in claim 1 or 4 wherein said distributor channel is located approximately in the outer third of the height dimension of said helix as measured radially from the outer surface of said shaft.

17. A mining auger as defined in claim 1 or 4 wherein said shaft and said helix are of stainless steel.

18. A mining auger as defined in claim 17, wherein said stainless steel is a chromium-molybdenum-nickel steel alloy.

19. A mining auger as defined in claim 1, further comprising an end ring welded to said shaft at the front end thereof and having a circular peripheral edge zone radially spaced from the shaft surface; a plurality of spaced additional tool holders arranged in the peripheral edge zone of said end ring for receiving additional cutting tool bits; separate additional spray nozzles arranged in the peripheral edge zone of said end ring and associated with each additional cutting tool bit; an additional liquid supply channel provided in the shaft; an additional distributor channel connected with said end ring and extending circularly about the auger shaft; said additional distributor channel communicating with said additional supply channel; additional connecting channels leading to individual additional spray nozzles and communicating with said additional distributor channel; an additional bridging channel carried by said end ring and extending radially away from the outer surface of said auger shaft; said additional bridging channel connecting said additional supply channel with said additional distributor channel.

20. A mining auger as defined in claim 19, wherein said additional bridging channel is a duct member of U-shaped cross section attached liquidtight along its free edges to an external wall face of said end ring.

21. A mining auger as defined in claim 2, 3 or 5 further comprising a stub channel connecting said bridging channel to said distributor channel and being oriented parallel to the auger axis.

22. A mining auger as defined in claim 2, 3 or 5 wherein each said connecting channel extends from said distributor channel to the respective spray nozzles in a direction radially away from said shaft 23. A mining auger as defined in claim 2, 3 or 5 wherein said additional distributor channel is a groove machined in an outer wall face of said end ring; the improvement further comprising a closure member covering said groove and being attached liquidtight to said outer wall face.

24. A mining auger as defined in claim 23, wherein said closure member is an annular strip welded to said outer wall face.

25. A mining auger as defined in claim 2, 3 or 5 wherein at least some of the channels have a corrosion-resistant lining.

26. A mining auger as defined in claim 25, wherein said lining is a plastic hose.

27. A mining auger as defined in claim 25, wherein said lining is a sintered plastic.

28. A mining auger as defined in claim 25, wherein said lining is a stainless steel coating.

29. A mining auger as defined in claim 28, wherein said stainless steel coating is a chromium-molybdenum-nickel steel alloy.

30. A mining auger as defined in claim 2, 3 or 5 wherein said distributor channel is located approximately in the outer third of the height dimension of said end ring as measured radially from the outer surface of said shaft.

31. A mining auger as defined in claim 2, 3 or 5 wherein said shaft, said helix and said end ring are of stainless steel.

32. A mining auger as defined in claim 31, wherein said stainless steel is a chromium-molybdenum-nickel steel alloy.

33. A mining auger as defined in claim 2, 3 or 5 further comprising a closure disc closing off said shaft at said front end thereof; and further wherein said shaft, said closure disc, said end ring, said helix and all the channels are stainless steel.

34. A mining auger as defined in claim 19, 2, 3 or 5, wherein said shaft, said helix and said end ring are stainless steel; further wherein all tool holders are welded to a respective tool holder bed constituted by a weldable steel and each tool holder bed associated with a tool holder is welded to said helix or said end ring, respectively.

* * * * *